United States Patent [19]

Niedecker

[11] Patent Number: 4,571,805

[45] Date of Patent: Feb. 25, 1986

[54] APPARATUS FOR CLOSING TUBULAR WRAPPERS WITH U-SHAPED CLOSING CLIPS

[76] Inventor: Herbert Niedecker, Am Ellerhang 6, D 6240 Königstein 2, Fed. Rep. of Germany

[21] Appl. No.: 652,708

[22] Filed: Sep. 19, 1984

[30] Foreign Application Priority Data

Sep. 20, 1983 [DE] Fed. Rep. of Germany ..... 3333875

[51] Int. Cl.[4] ..... B23P 11/00

[52] U.S. Cl. ..... 29/243.56; 53/138 A; 227/120

[58] Field of Search ..... 29/243.56; 53/138 A; 227/120

[56] References Cited

U.S. PATENT DOCUMENTS 3,095,308 6/1963 Rumsey ..... 53/138 A
3,587,204 6/1971 George ..... 53/138 A

FOREIGN PATENT DOCUMENTS 1285417 1/1962 France ..... 53/138 A
2463059 3/1981 France ..... 53/138 A

*Primary Examiner*—James L. Jones, Jr.
*Attorney, Agent, or Firm*—Sprung, Horn, Kramer & Woods

[57] ABSTRACT

In apparatus for closing tubular wrappers with U-shaped closing clips, wherein two spaced apart closing clips are simultaneously pushed onto the die and are closed there around the gathered end of the wrapper, and wherein the closing clips are supplied to the two clip-guiding passages from magazine means, it is desired to permit a loading of the closing clips for both guiding passages from only one side. The closing clips (b) required for closing the wrapper are delivered to both clip-feeding passages (7) from a single magazine rod (1) and an intermediate member (4), which constitutes an extension of the magazine rod (1), is provided between the two clip-guiding passages (7) so that two additional closing clips (6) are delivered from the magazine rod (1) when the two punches (3) are retracted and each clip-closing passage (7) is thus supplied with a new closing clip (6).

1 Claim, 4 Drawing Figures

APPARATUS FOR CLOSING TUBULAR WRAPPERS WITH U-SHAPED CLOSING CLIPS

This invention relates to apparatus for closing tubular wrappers with U-shaped closing clips, wherein two spaced apart closing clips are simultaneously pushed by respective punches in respective clip-guiding passages onto the die and are closed there around the gathered end of the wrapper.

In such closing apparatus, the operator must usually load the closing clips, which are held together in clip bars, onto the two mutually opposite magazine rods. Individual closing clips are then consecutively received by each clip-guiding passage. This loading operation is inconvenient because the magazine rods are arranged in mirror symmetry and must be spaced apart. As a result, the operation is time-consuming and particularly great difficulties will arise in the operation of high-speed machines which must be reloaded in short intervals. For this reason, it is desired and an object of the invention to provide such a double-clip machine which can be loaded with the closing clips for both guiding passages from one and the same side.

This object is accomplished in accordance with the invention in that the closing clips required for closing the wrapper are delivered to both clip-feeding passages from a single magazine rod and an intermediate member, which constitutes an extension of the magazine rod, is provided between the two clip-guiding passages so that two additional closing clips are delivered from the magazine rod when the two punches are retracted and each clip-closing passage is thus supplied with a new closing clip. That intermediate member provided between the two clip-guiding passages receives a plurality of closing clips from the magazine rod and said individual closing clips are delivered in succession from the intermediate member to the second clip-guiding passage whereas the first clip-guiding passage receives the next required clip directly from the magazine rod. As a result, two additional closing clips are delivered when the closing operation has been completed and the punches have been retracted, the one of said two closing clips is delivered to the intermediate member of the other into the first clip-guiding passage. After the next closing operation, the intermediate member is refilled in the same manner. If the closing clips are delivered to the two clip-guiding passages in this manner, the distance between said passages must be a multiple of the width of each clip.

In order to compensate clip width tolerances, it is desired so to design at least the first punch at the end facing the magazine so that the shank of the punch gradually tapers in thickness toward the forward end face of the punch on that longitudinal side which faces the clip-guiding passage so that the thickness of the punch at its forward end face does not exceed 85% of the full thickness of the shank of the punch, as is disclosed in the prior German Patent Application P 33 16 586, which is no prior publication.

An advantage afforded by the apparatus in accordance with the invention resides in that only one clip magazine must be loaded by the operator so that the handling of the clips is greatly simplified. Besides, the closing clips may be automatically supplied to the clip magazine. Finally, the apparatus in accordance with the invention is particularly suitable for use in conjunction with a horizontal closing machine, e.g., with a closing machine to which the tubular wrapper is supplied in a vertical direction. In that case, the use of two magazine rods rendered the supply of the clips to the second magazine rod particularly difficult because said clips had to be supplied from below.

When the punches are in their upper position, a closing clip which has been separated from the clip bar and has been delivered must not slip into the clip-guiding passage at the receiving end thereof because this would render the pushing of such clips more difficult. For this purpose, a resilient bridging member is suitably provided, which retains such closing clip in its initial position but is depressed downwardly by the punch as it is actuated. Such means for retaining the closing clip are not required at the rear clip-guiding passage because a closing clip slipping into said passage will not obstruct the pushing of such clip and will not disturb the sequence of operations.

The invention will now be explained with reference to the drawings.

FIG. 1 is a sectional view showing a closing machine comprising a magazine rod 1 and a guide rod 2.

Figure 1:
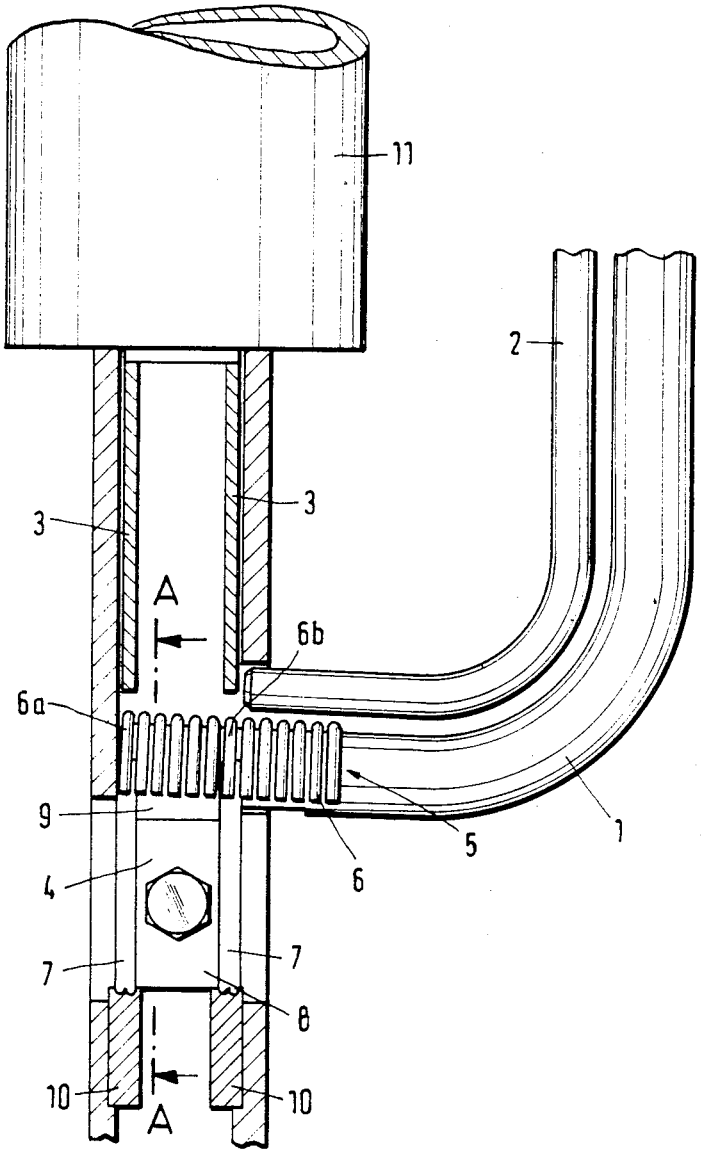
FIG. 1 is a side elevation showing the closing machine in its initial position with retracted punches.

Between the punches 3, the magazine rod is extended by an intermediate member 4. Part of the clip bar 5 consisting of a plurality of clips is held on the intermediate member 4 and on the end portion of the magazine rod 1. Clip-guiding passages 7 are also provided.

Figure 2:
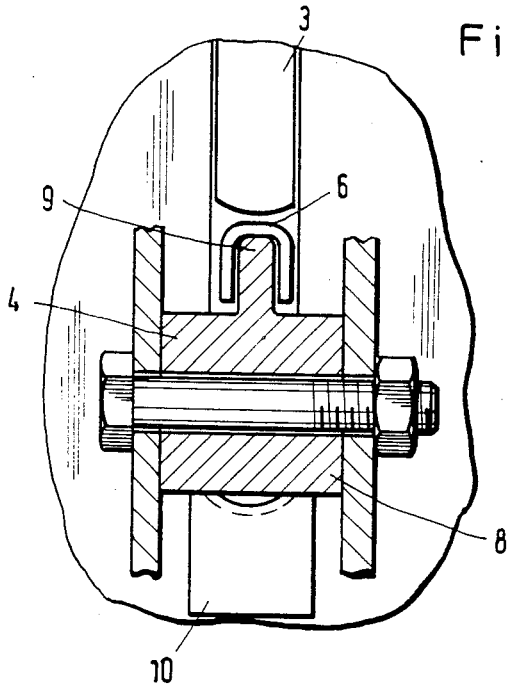
FIG. 2 is a vertical sectional view in the direction of the arrows on the line A—A in FIG. 1.

FIG. 2 shows the punch 3 and a clip 6 disposed on the intermediate member 4. The intermediate member 4 consists of a base 8 and a part 9, which constitutes an extension of the magazine rod 1 and conforms to the clip. The die 10, against which the clip 6 is closed, is disposed below the intermediate member.

Figure 3:
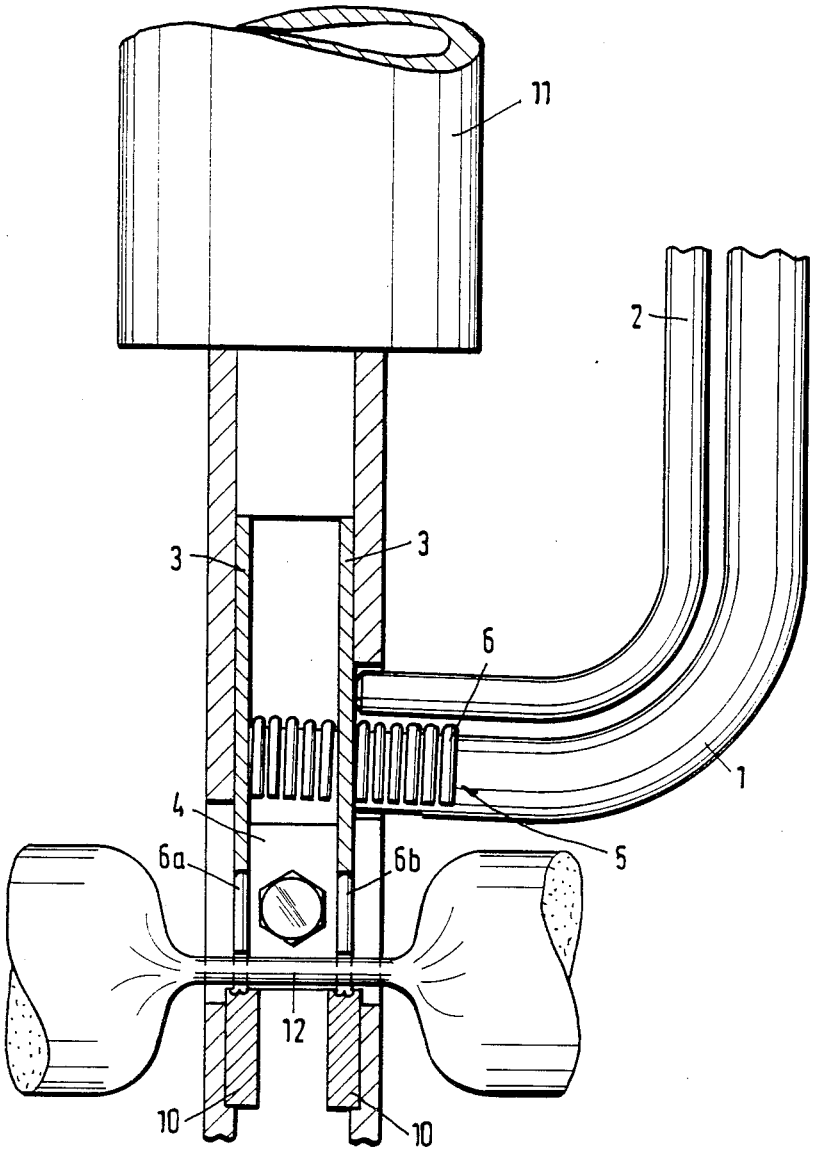
FIG. 3 shows the same closing machine as FIG. 1 after the punches have performed part of their stroke to the closing station.

In the position shown in FIG. 3, the piston in the pneumatic cylinder 11 has moved the punches 3 toward the die 10 so that the punches 3 have advanced two clips **6*a* and 6*b* from the clip bar 5** toward the closing station.

As the stroke of the piston in the pneumatic cylinder 11 is continued, the clips **6*a* and 6*b* are closed against the die 10 around the gathered end 12 of a bag or of a tubular casing. When the piston has been completely retracted, the punches have returned to their initial position shown in FIG. 1. Additional clips 5 can now slip into the spaces that have been left by the clips 6*a* and 6*b*** so that a continuous row of clips is formed.

Figure 4:
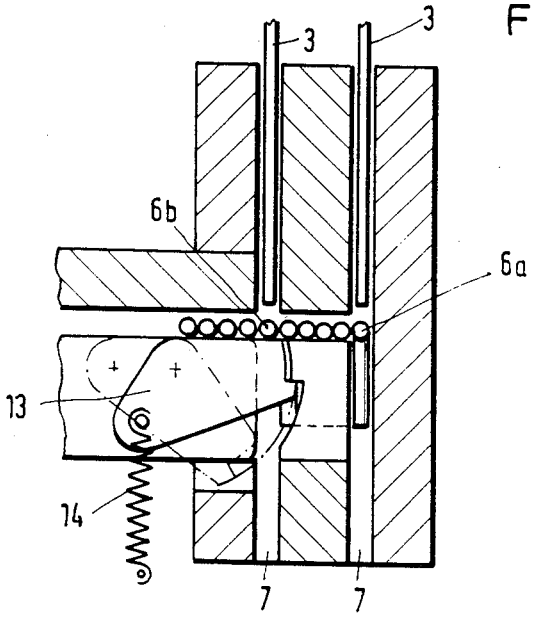
FIG. 4 shows a special design of the clip-receiving region with bridging means provided between the magazine rod and the intermediate member.

FIG. 4 shows a resilient bridging member 13. When the punches 3 have been retracted to their upper or initial position, shown in FIG. 1, said bridging member 13 extends between the magazine rod 1 and the intermediate member 4 and closes the clip-guiding passage 7 at that end at which the clips 6 are received. As the punches 3 perform their downward stroke, the bridging member 13 is sufficiently depressed by the punches 3 against the restoring force of the spring 14 so that the clip **6*b* and the punch 3 can move past the bridging member 13**.

It will be understood that the specification and examples are illustrative but not limitative of the present invention and that other embodiments within the spirit and scope of the invention will suggest themselves to those skilled in the art.

I claim:

1. In an apparatus for closing tubular wrappers with U-shaped closing clips, including a magazine for clips, a pair of spaced apart punches for simultaneously pushing and closing a pair of closing clips from said magazine in respective clip-guiding passages onto a die and there closing said clips around the gathered end of the wrapper, and means for advancing said punches from retracted position to clip advancing and closing position, the improvement which comprises providing a single magazine rod for supplying clips to both clip-feeding passages, and an intermediate member which constitutes an extension of the magazine rod provided between the two clip-guiding passages, whereby when the two punches are retracted two additional closing clips are delivered from the magazine rod and each clip-closing passage is thus supplied with a new closing clip.

* * * * *